United States Patent [19]

Shoji et al.

[11] 4,012,076

[45] Mar. 15, 1977

[54] PROCESS FOR HYDRAULICALLY MINING COAL

[75] Inventors: Kouichi Shoji, Tokyo, Japan; Ronald E. Sieling, 31 Waterhouse Ave., St. Ives, New South Wales, 2075 Australia; Joe T. Taylor, St. Ives, Australia; Robert G. Heers,

[73] Assignee: Kaiser Resources Ltd., Vancouver, Canada; Mitsui Mining Co., Tokyo, Japan; a part interest to each

[22] Filed: Oct. 31, 1974

Under Rule 47

[21] Appl. No.: 519,625

Related U.S. Application Data

[60] Division of Ser. No. 350,509, April 12, 1973, abandoned, and a continuation-in-part of Ser. No. 299,200, Oct. 20, 1972, abandoned.

[30] Foreign Application Priority Data

Apr. 13, 1972 Canada ..... 139608

[52] U.S. Cl. ..... 299/17; 299/18; 302/14

[51] Int. Cl.[2] ..... E21F 41/00

[58] Field of Search ..... 299/17, 18, 19; 302/14–16

[56] References Cited

FOREIGN PATENTS OR APPLICATIONS

| | | | |
|---|---|---|---|
| 725,276 | 3/1955 | United Kingdom | 299/17 |
| 599,284 | 3/1948 | United Kingdom | 299/18 |

OTHER PUBLICATIONS

Boyd, Bureau of Mines Info. Circular 7887, 1959, pp. 1–33.

"The Japanese Search for Raw Materials", Mining Congress Journal, Feb. 1971.

Bureau of Mines Translation No. 216, 1957, pp. 430–442.

*Primary Examiner*—Ernest R. Purser

[57] ABSTRACT

The invention is to a method for the hydraulic mining of coal of varying hardness. It is described in particular as to coal of the type occurring in the Balmer Seam in British Columbia. By the method at least two parallel spaced entries are driven upward through a seam of coal. Monitors are positioned in each entry. Each monitor is horizontally and vertically pivotable, and has nozzle means from which a jet of water under a pressure of about 1900 – 2200 p.s.i. is emitted. The high pressure jet cuts the coal, which is then fed to a machine that breaks and crushes the coal into sizes wherein the resultant coal/water slurry will flow down a sloped flume into a dewatering station.

The method further embodies differentially retreating along adjacent parallel entries by increments of desirably at least about 40 feet each. By the different retreat system, as a panel of coal is hydraulically mined in one entry, the monitor and associated equipment is a second adjacent parallel entry are moved back the desired increment to the next working position (retreated). When the panel of coal in the first entry is mined, the monitor is retreated in the same manner and hydraulic mining commences in the second adjacent parallel entry. The operation is thus alternated along the length of the parallel entries.

28 Claims, 4 Drawing Figures

PROCESS FOR HYDRAULICALLY MINING COAL

This application is a division of application Ser. No. 350,509 filed Apr. 12, 1973, now abandoned and a continuation-in-part of application Ser. No. 299,200 filed Oct. 20, 1972 for Process for Hydraulically Mining Coal and now abandoned.

This invention relates to an improved process for hydraulically mining coal.

Hydraulic mining of coal offers several potential advantages. If properly operated it is possible to effect a more complete recovery of a given coal reserve and to substantially reduce the cost of mining coal by using less labor and equipment than in other coal mining methods.

More complete recovery of the reserve results from the ability to more precisely select the areas in the coal mine which are to be worked, so that it is possible to remove the mined coal to a conveying system, and to terminate hydraulic mining when the coal in a particular area or sone of a seam is exhausted and the shale or rock is reached.

In hydraulically mining coal, it is desirable to create an upwardly sloping entry through a seam of coal, this operation being known as developing the entry. Then a stream of water under high pressure, i.e., a jet, is directed against the face, roof and sides of the developed entry, thereby breaking up the coal seam and forming a slurry of coal. The coal/water slurry flows down the sloping entry whereupon it may be partially dewatered and such further treatment as may be desired.

Furthermore, other major advantages in hydraulic mining lie in the ability to mine a seam of coal that has such a heavy overburden that it is impractical to strip mine. Also, a coal seam that is on a relatively steep slope or pitch is susceptible to hydraulic mining in contrast to mechanized mining where the costs of equipment and the operation thereof are prohibitive. For example, tunnels or entries which slope 1 foot over a distance of 3 to 4 feet cannot for all practical purposes, be worked with machinery because of the lack of any relatively level surface. On the other hand, hydraulic mining is ideally suited for such sloping seams regardless of the degree of slope, and potentially is the only economically feasible method. Labor costs and the slow rate of production eliminate hand mining from consideration.

In the past it has been very difficult to employ hydraulic mining on coal of relatively great hardness. This is caused by the fact that the high pressure cutting jet usually cuts the coal into lumps or chunks that are too large to transport economically from the mining site, particularly if hydraulic transport is to be used.

The present invention has as one of its object the provision of an improved process for the hydraulic mining of coal from a seam or panel of coal. More specifically, it is an object of the invention to provide an improved procedure and technique for winning coal from a seam at a high production rate using a minimum amount of labor while obtaining maximum available recovery of coal from the reserve. The hydraulic mining method is economic in cost and can be practiced in steeply pitched or sloping seams of coal of varying hardness that are not otherwise workable from a practical commercial point of view.

The process of the present invention will be hereinafter described as it may be used in its various applications, including that of winning coal from a seam of Balmer coal. It is to be understood, that the instant process is applicable to winning other types of coal, depending on the hardness thereof as well as its cleat, cleavage, and friability characteristics.

According to the invention, one proceeds by first driving two parallel entries pitched in an upwardly direction from the horizonal, through a seam of the coal to be mined, such as the coal found in the Balmer No. 10 seam in the Natal area of the Fernie Basin, British Columbia, which is described in Paper 63-35 of the Geological Survey of Canada, Department of Energy, Mines and Resources, 1968, entitled "The Petrology of the No. 10 (Balmer) Coal Seam in the Natal Area of the Fernie Basin, British Columbia."

In one major segment of the particular Balmer Seam that has been mined by the process of the invention, the average thickness of the coal seam is about 50 feet and it has an average pitch of about 30°.

This invention is characterized by its effectiveness in such relatively wide and sloping coal seams that thus enable the cutting jet to be effective at wide angles to both the horizontal and vertical. For example, the monitor can work to its right and left within a range of 180° from the point in the entry where it is located, and it can cut coal at a vertical angle overhead that approaches 90°, the limitation in the latter instance being the safety of the operator. The great width of the Balmer seam and its slope of 30° or more, therefore furnishes an excellent opportunity for the efficient use of this invention.

The parallel entries are driven upwards through the seam to a predetermined terminus, at an average slope of about 7°, the entries being horizontally spaced relative to each other an average distance of about 35 feet. However, the distance can be as great as 200 feet, or as close as 20 feet, depending on characteristics of the coal, the jet pressure, and the like. The higher the pressure and the greater the quantity of water of the jet stream, the greater the distance at which coal of a given cleat, cleavage, and friability can be mined. The greater the distance between adjacent developed entries and consequently the greater the size of panels between seams, the greater are the economies in labor and time that can be realized in an hydraulic mining operation because the major cost lies in developing the entries, even though entries can be developed by hydraulic mining or combination systems comprising conventional cutting and fluming.

After the entries have been driven, there is then positioned, within one of the entries, a monitor which is adapted for pivotal movement vertically and horizontally as heretofore described and having nozzle means for ejection of a high pressure jet of water. Water under pressure is fed to the nozzle. Remote means are provided for controlling the direction of the jet.

A second monitor, like the first, is positioned within the adjacent parallel entry.

In operation, water is controllably ejected from the nozzle of the monitor at an average rate of at least 1000 gallons per minute (gpm) against the surfaces of the panel of the coal to be mined. However, the quantities of water that can be used vary from 500 to 3000 gpm, depending on the condition in the mine.

The pressure of the jet stream leaving the monitor in the Balmer Mine averages between 1900 and 2200 p.s.i. However, the range of pressures that can be used may vary from 500 to 3000 p.s.i., depending on the hardness of the coal and the cleat, cleavage and friability of the coal.

One of the major features of this invention is that it permits the use of the high cutting pressures referred to above and at the same time solves the problem of efficiently removing the large lumps and pieces that are usually nontransportable. By this invention the cut coal is picked up by, and flows onto a moving grate, that feeds the coal to a crusher that breaks the coal into pieces of less than 6 inches maximum cross-section.

This feeder-breaker machine deposits the coal onto the flume with fine coal and other pieces of a size that normally do not need breaking or crushing. The coal is in slurry form due to the water from the cutting jet.

After the available coal in the panel has been mined, the monitor is retreated as heretofore mentioned, that is moved back into the entry an average distance of about 40 to 50 feet. The actual distance is practically dependent on the nature of the coal and it may range from 10 feet to 100 feet down the entry so as to provide a new working position adjacent the panel of coal. Meanwhile, the second monitor in the adjacent parallel entry is activated to conduct a similar mining operation. The aforesaid sequence of steps is referred to hereinafter as "differential retreat."

The resulting slurry of coal and water is directed into a flume and transported outside the mined area for dewatering and the like.

The foregoing method of operation will be more fully understood in the light of the accompanying drawings, wherein.

Figure 1:
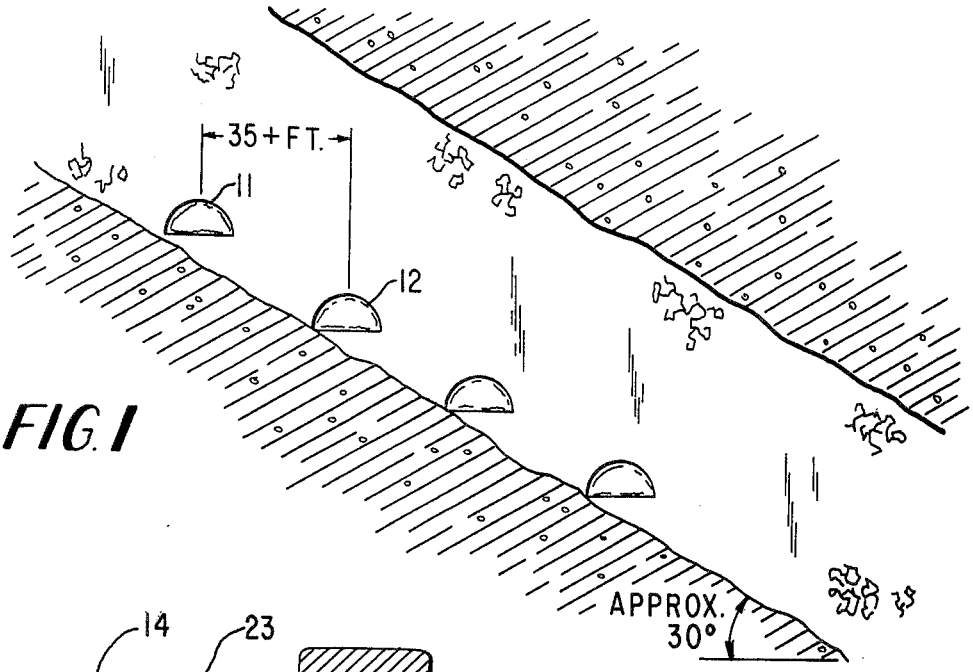
FIG. 1 is a sectional view of a geological formation containing a vein or seam of coal, and showing an arrangement of openings, which will hereinafter be referred to as "development headings," used in practicing the present method.

Referring more in detail to the drawings, FIG. 1 illustrates a section through a part of the geological formation which contains the coal seam as Balmer No. 10 located in the Natal area of the Fernie Basin, British Columbia. The coal seam is pitched approximately 30° and averages about 50 feet thick.

In carrying out the present hydraulic mining method on Balmer coal, a pair of development entries 11 and 12 having an average slope of $7° \pm 2°$, are formed. They are substantially parallel relative to each other and extend an average distance of at least about 20 feet, and more often 50 to 60 feet as heretofore described. The entries are shaped generally as shown in section in FIG. 1 with arches on five-foot centers and are each connected to a main tunnel or entry through the mine (not shown).

Figure 3:
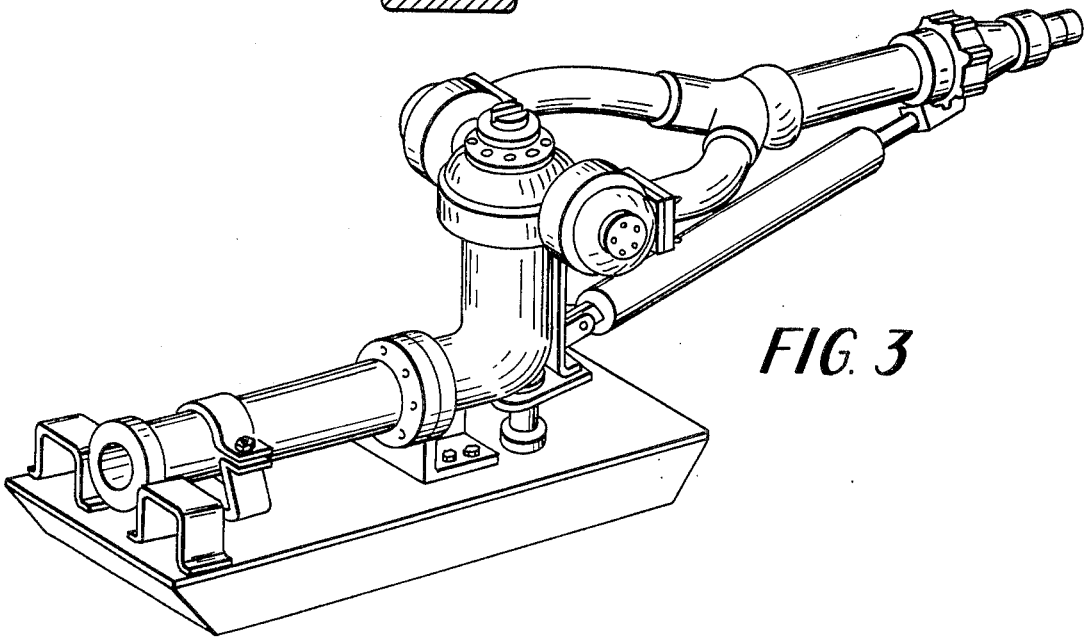
FIG. 3 is perspective view of a preferred form of monitor used in the present method.

A monitor 13 is positioned within entry 11 and a similar monitor (not shown) is positioned within entry 12. The monitor 13, shown in FIG. 3, comprises a high pressure water jet means having a detachable nozzle, and is connected to a conduit which delivers water thereto under high pressure from a pump, not shown.

In an efficient embodiment of the present method, the water pressure at the monitor nozzle 14, is around 1900 – 2200 p.s.i., and the water is emitted therefrom at the rate of about 1100 gpm. The monitor 13 is positioned at a point in the entry immediately adjacent the face of the panel of coal which is to be won and removes the coal therefrom that is within the effective range of the monitor, which may be about 60 – 70 feet, or as great as 200 feet depending on conditions.

The monitor 13 is adapted for pivotal motion, and is vertically and horizontally controlled by remote means as at 16 for effecting said pivotal motion.

Figure 4:
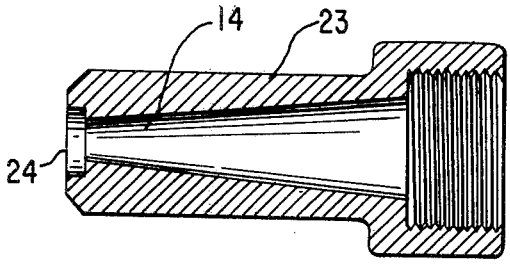
FIG. 4 is a sectional view of a nozzle tip such as used in the present method.

The nozzle 14 shown in FIG. 4, is formed of metal and adapted to be threadably secured to the monitor 13. The nozzle has a tip 24 having a tapered passageway 23. The passageway 23 may taper, in a useful system such as is shown in FIG. 4, a distance of about 120 mm from a diameter of about 50 mm to a diameter at the tip 24 which may range from 18 to 30 mm. However, the nozzle dimensions depend on the desired pressure and quantity of the water to be ejected, and can be varied accordingly. For example, the nozzle diameter may be as large as 40 mm for certain special applications.

Of the types of monitor nozzles used, one having an inside diameter of about 24 mm at the tip has been found useful for cutting coal at distance of around 40 – 70 feet. The nature of the coal in the panel largely controls the thickness of the coal/water slurry, and hence the quantity of water used. Thus, at the far distance the weight ratio may be 1:2 (i.e. the fixed water flow rate is about 4 tons per minute and the coal rate is about 2 tons per minute). At relatively close distances, the coal/water weight ratio may vary from 1:2 to 4:1, so that one can obtain 4 tons of coal per ton of water in very soft-sheared coal.

A 22 mm nozzle may be used for extremely hard coal at all distances up to approximately 20 feet, with the coal/water ratios running about 1:4 to 1:3 by weight. Under extremely bad conditions, in 400 minutes (100% of available shift time) good production would be 600 tons. By comparison, in soft coal, and using the large 24 mm nozzle, a yield on the order of 2200 tons per shift is obtained in 400 minutes of operating time.

The following is a further description of the steps and techniques used in carrying out the process of the invention:

With the monitor 13 in place, the nozzle 14 is directed toward the face of the coal panel which, as mentioned above, is immediately adjacent the nozzle. The water, under pressure of about 1900 – 2200 p.s.i. is turned on. The water leaving the nozzle 14 at a rate of ranging from 900 – 1500 gpm, and advantageously about 1100 gpm, is controllably directed and ejected against the panel. The sequential movement pattern of the stream against the panel may vary.

In one sequence, for example, the under-cutting step is carried out so that it comprises not more than about 10% of a controlled hydraulic mining time period, the top coal and pillar removal step comprises about 60% of such time period, and the boiling-up step is thus not more than about 30% of that period.

The sequence of steps employed in the operation of monitor 13, whether manual or automatic, varies with the nature of the coal. The operator may find it expedient to first undercut the panel, then proceed with the hanging wall or top coal and pillar removal and a boiling-up step to further particulate the coal with the high pressure jet. However, variations of these sequences are frequently employed and particulating steps may not be needed, or undercutting need not always be done.

The average solids to water ratio in the coal slurry produced according to the herein described process ranges between a ratio of about 1:4 to a ratio of about 1:0.5. The coal/slurry may then be dewatered. However, the greater the ratio of coal to water, the greater the efficiency of the mine operation.

In operation, it is necessary to work with entries which slope to ensure flow by gravity of the coal/water slurry out of the area where mining is being conducted and along the flume towards the dewatering system. The flume may be of any durable type of material. In the operation explained herein, steel flumes are used and the 7° slope (which may vary by ± 2°) provides satisfactory gravity-induced flow rates so long as the coal is broken into particles generally not exceeding one half the width of the flume in their largest cross-section. Where other materials are used for the flumes, the slope of the flume may vary because of the friction effect. For example, a flume of glass fibers is operative with coal/water slurries, as contemplated herein, with a lesser slope than that of steel, e.g. a 4° slope ± 2°. The flume and flume lining can employ different materials depending on mining conditions, costs, durability and other factors, as those skilled in the art can readily appreciate.

A flume system for removal of mined coal provides still another advantage that can be realized by the hydraulic mining method, in contrast to other continuous or semicontinuous mining methods wherein belt conveyors are used to transport the coal from the mining area. Belt conveyors are very expensive to install and maintain. Also, conveyor belts are unwieldy because the length of the conveyor belt system is difficult to adjust, and it becomes impractical to do so where relatively rapid retreat along an entry occurs, as in the hydraulic mining method explained herein. Further, where relatively sharp changes in direction are necessary, such as a 30° turn from an entry to another passage in the mine, expensive transfer equipment is needed for the belt conveyor system. In contrast, the flume systems not only are more durable, but are inexpensively disassembled and reassembled for changes in length. Generally the flume system is comprised of individual sections, or pan type unit, 10 to 12 feet in length, and about 24 inches wide, so that as the mining operation proceeds, the length of the flume can be adjusted by the operator by lifting a unit on or off the line. Likewise, at the junctions where the direction of flow of the slurry changes, the flume system means can be simply adjusted by hand to effect the change in direction of flow.

Another novel feature of this invention is that it contemplates the use of a conventional mining machine in combination with a fluming system. Notwithstanding the disadvantages of a continuous mining machine under certain circumstances, there are still other conditions where the continuous miner and the hydraulic transport furnished by the flume can be quite advantageous. For example, in mines wherein the gradient of the seam is not very great, i.e. on the order of 7° to 12°, and the coal seam is not of great thickness, i.e. about 3 to 10 feet, the continuous miner can be worked with great efficiency because the mined coal of a satisfactory size can be fed directly to the flume with a stream of water of sufficient volume to form a slurry to transport the coal to the point in the mine for dewatering and/or further transport from the mine. This combination system is intended to reduce the number of operating personnel, i.e. labor expense in the mine and to eliminate the need for costly equipment such as the shuttle car and the belt conveyor which are usually used for transport purposes in the continuous miner mining system. It is possible to use this combination system in developing entries in hydraulic mines.

It is to be noted that the system herein described is capable of operation in mines wherein the adit, or mine entrance, is either above or below the mining operation. The mining operation, herein described with respect to the Balmer No. 10 seam, is carried out above the mine adit so that the coal/water slurry flowing along the flume and out of the mine by gravity flow alone. Where the entrance of the mine is above the mining operation, the slurry flows along the flume to a pumping station located at a convenient point below ground (generally the lowest point in the mine) where the coal may be partially dewatered, if desired, but in any event wherein the slurry (whether partially dewatered or not) is transported out of the mine. This may be handled by pumping through pipe lines through the mine shaft or any other convenient method. Obviously the cost of removal by such a pumping arrangement may be more expensive than gravity flow only. However, it can still be advantageous to use the hydraulic mining method with the pumping system because of the other substantial cost advantages in the hydraulic mining method.

The slurry may flow down to the surface where the reserve being worked is at a higher level than the dewatering plant at the surface. Where the coal deposit is below the mine entrance, the coal may be partially dewatered underground and can then be pumped out, or the entire coal/water slurry can be pumped out. The sizing of the coal will control. Known methods are used to transport the coal/water mixture.

The operational sequence depends on the type of conditions prevailing in the mining area, such as softness of the coal, overburden weight, caving action of the roof and the like. Production rates may vary from as low as about 1400 – 1500 tons per day of coal to about 4500 – 5000 tones per day of coal, with a typical operation averaging about 2500 tons per day.

In general, the following is an average ore cutting sequence that has been used for Balmer coal:

1. Under-cutting the seam consumes a minimum of 10% of the available time. The coal/water ratio is 1:4, for such low production rate.
2. The top coal and pillar removal step, which may consume 60% of the available time and employ a coal/water ratio of 1:2 to 1:1.
3. The boiling-up and out and caved coal transfer onto the feeder-breaker consumes 30% of available time. The coal/water ratio ranges from 1:1 to 4:1.

As a result of the above-described steps, the coal/water slurry which is formed flows downwardly (due to the entry slope of 7° ± 2°), and is directed by one or more dams 17, 18 formed of wooden planks or steel sheet, into a flume 19, where it is conducted to a further processing area (not shown).

Figure 2:
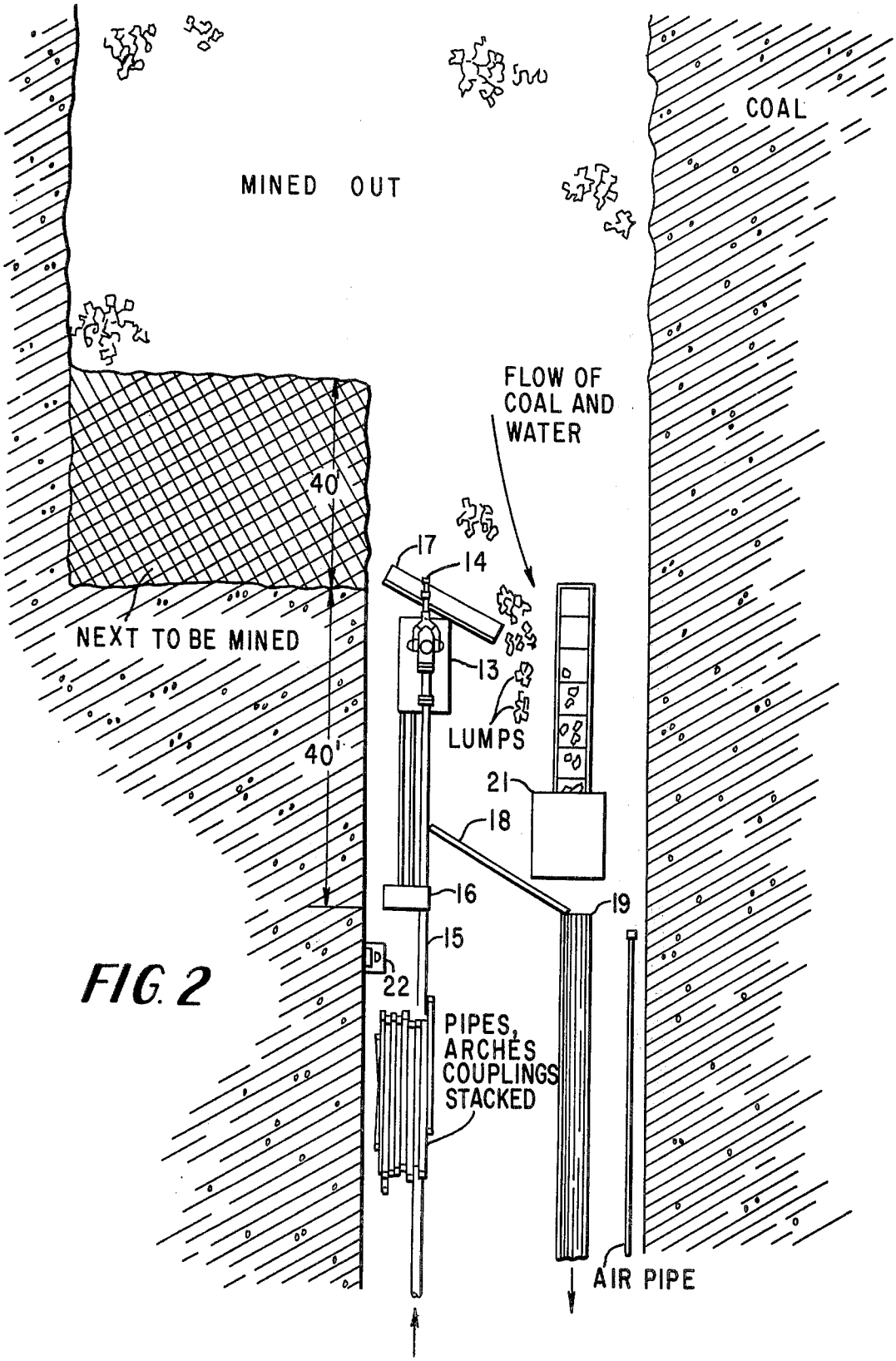
FIG. 2 is a plan view of one of the development headings shown in FIG. 1, illustrating the manner of operation of the present invention.

The controlled hydraulic mining period above referred to is the time period during which a substantial fraction of available coal is removed from the panel by the monitor while the monitor is operating from one position. Following such period, a substantial portion of the coal panel having become "mined out," the monitor 13 is moved back by an increment of 20 – 60 feet, and the procedure is repeated. Moving the monitor necessitates disconnection and removal of appropriate sections of the hydraulic pipe 15 and couplings thereof followed by reconnection of the monitor 13 after the move. Other equipment such as telephone 22 (see FIG. 2), remote controls 16, the feeder-breaker 21, and the dam construction 17, 18, is also moved back the same distance.

As soon as mining of a panel and removal has been completed in the No. 1 entry or sublevel, mining commences in the adjacent No. 2 entry or sublevel, and the process is alternated so as to effect differential retreat by increments as above described.

As example wherein one complete cycle of preparations and mining in a sublevel (referring for convenience to FIG. 2) is accomplished as follows, it being assumed that the adjacent sublevel (e.g. No. 1) is mined out, the roof has caved, and the monitor with the supporting and associated equipment is to be moved back a distance of about 42 feet:

1. Remove accumulated rock from the monitor and feederbreaker.
2. Disconnect the monitor from the hydraulic pipe line.
3. Remove sufficient hydraulic pipe and couplings to enable the monitor to be moved back.
4. Couple the monitor back to the pipe line.
5. Move the monitor controls back and set them up for operation.
6. Remove a corresponding length of trough.
7. Pull the feeder back.
8. Remove approximately the same length of roof arches.
9. Stack all pipe, couplings, arches and planks behind the monitor control panel.
10. Move the air lines and mine phone back.
11. Place the dame or trough in front of the monitor.

Mining can now proceed. As soon as mining is finished in one sublevel, mining is begun in the adjacent sublevel and the above procedure repeated in that sublevel.

Another characteristic of this invention is that a two-monitor or dual system can be used in each entry. By this dual system a cutting monitor and a breaking monitor are used. The cutting monitor operating at a relatively high pressure suitable for cutting coal in an effective range, is employed to remove or cut the coal from the panel being mined. The second monitor in the same entry is then activated to break and crush the large rocklike pieces of coal, i.e. to perform the boiling-up step heretofore mentioned. The pressure of the No. 2, or boiling-up monitor, will depend on the size and nature of the pieces to be cut, but it ordinarily need not be as great as that of the cutting, or No. 1 monitor. The two monitors can operate in sequence or simultaneously, depending on mining conditions.

The foregoing detailed description illustrates the advantages and method of carrying out the process, however, it is to be understood that variations within the skill of the art may be made within the scope of the invention, and accordingly the foregoing description, including the matter set forth in the drawing is to be considered illustrative and not limiting, except as defined by the following claims.

We claim:

1. The method of hydraulically mining coal from a panel of coal of preselected average thickness comprising:

1. driving at least one entry upward through the panel to a predetermined terminus thereof at an average slope of at least about 5°;
2. installing a fluming system in said entry that slopes in the same direction as the entry;
3. positioning a monitor within said entry, said monitor comprising a nozzle adapted for pivotal motion vertically and horizontally, and being connected to means for receiving water under pressure;
4. ejecting a jet of high pressure water from said nozzle against the panel of coal to cut the coal from the face area of the panel and break the coal into pieces of varying size;
5. feeding the cut and broken coal through a further breaking means located near said face area prior to transporting the coal from the face area;
6. feeding the coal from the breaking means to said fluming system; and
7. transporting the mined coal with the aid of gravity through said sloping fluming system with water from the nozzle as a coal-water slurry.

2. The method as defined in claim 1 wherein said breaking means comprises a mechanical breaker.

3. The method as defined in claim 2 wherein said mechanical breaker is positioned in the entry adjacent to the face area.

4. The method as defined in claim 2 wherein the coal fed to said mechanical breaker is broken by said mechanical breaker into pieces of less than about 6 inches maximum cross-section.

5. The method of hydraulically mining coal from a panel of coal of preselected average thickness comprising:

1. driving at least one entry upward through the panel to a predetermined terminus thereof at an average slope of at least about 5°;
2. installing a fluming system in said entry that slopes in the same direction as the entry;
3. positioning a monitor within said entry, said monitor comprising a nozzle adapted for pivotal motion vertically and horizontally, and being connected to means for receiving water under pressure;
4. ejecting a jet of high pressure water from said nozzle against the panel of coal to cut the coal from the face area of the panel and break the coal into pieces of varying size;
5. passing substantially all of the cut and broken coal through a further breaking means located near said face area prior to transporting the coal from the face area;
6. feeding the coal from the breaking means to said fluming system; and
7. transporting the mined coal with the aid of gravity through said sloping fluming system with water from the nozzle as a coal-water slurry.

6. The method as defined in claim 5 wherein water ejected from the monitor and the coal cut and broken thereby form a slurry which flows down the gradient of the entry to said further breaking means.

7. The method defined in claim 5 wherein the coal after leaving the said breaking means is moved in the form of a coal-water slurry along said flume by gravity to a pumping station.

8. The method defined in claim 5 wherein the coal after leaving the said breaking means is moved in the form of a coal-water slurry along said flume by gravity out of the mine.

9. The method defined in claim 5 wherein the coal after leaving said breaking means is moved in the form of a coal-water slurry along said flume by gravity to a dewatering station.

10. The method defined in claim 5 wherein the further breaking means is a mechanical feeder-breaker.

11. The method defined in claim 6 wherein the further breaking means is a mechanical feeder-breaker.

12. The method defined in claim 5 wherein the monitor and the further breaking means are positioned within the entry under, and thereby protected by, the roof arches of the entry in operative relation to the face area to be mined.

13. The method defined in claim 5 wherein the monitor is adapted for pivotal movement to the right and left within a horizontal range of about 180° and, throughout said horizontal range, vertically overhead within a range of about 90°.

14. The method defined in claim 5 wherein the monitor is capable of cutting coal up to an effective distance of about 200 feet.

15. The method defined in claim 5 wherein the pressure of the jet stream leaving the monitor is within the range of about 500 to 3000 p.s.i., the quantity of water ejected is at a rate within the range of about 500 to 3000 g.p.m., and the monitor has a cutting range of up to about 200 feet.

16. The method as defined in claim 5 wherein the pressure of the jet stream leaving the monitor is within the range of about 1900 to 2200 p.w.i.

17. The method as defined in claim 5 wherein the rate of water ejection from the monitor is in the range of about 900 to 1500 g.p.m.

18. The method as defined in claim 5 wherein the monitor is capable of cutting coal up to an effective distance of about 70 feet.

19. The method as defined in claim 5 wherein the ratio of coal to water in the coal-water slurry varies from 1 part coal to 2 parts water to 4 parts coal to 1 part water.

20. The method as defined in claim 5 wherein coal removal in the entry is effected in increments, the monitor and further breaking means being moved backwards down and along said entry upon completion of mining in a face area and repositioned for resumption of the mining operation in the adjacent area of the entry.

21. The method as defined in claim 5 wherein coal removal in the entry is effected in increments, the monitor and further breaking means being moved backwards down and along said entry from about 10 to about 100 feet upon completion of mining in a face area and repositioned for resumption of the mining operation in the adjacent area of the entry.

22. The method as defined in claim 5 wherein coal removal in the entry is effected in increments, the monitor and further breaking means being moved backwards down and along said entry from about 20 to about 60 feet upon completion of mining in a face area and repositioned for resumption of the mining operation in the adjacent area of the entry.

23. The method as defined in claim 5 wherein the driving of said entry is effected by said monitor.

24. The method as defined in claim 5 wherein at least two parallel adjacent entries are driven into a panel of coal, and coal removal and retreat of mining equipment is effected in alternating differential increments, so that the coal is removed from a location in one entry while the coal mining equipment is retreated in the parallel adjacent entry.

25. The method as defined in claim 5 wherein at least two parallel adjacent entries are driven into a panel of coal, said entries being spaced apart at least about 20 feet.

26. The method as defined in claim 10 wherein at least two parallel adjacent entries are driven into a panel of coal, said entries being spaced apart a distance ranging from 20 to 200 feet.

27. The method as defined in claim 10 wherein the coal is broken by said further breaking means into pieces of less than about 6 inches maximum cross-section.

28. The method as defined in claim 10 wherein the cutting and breaking performed by the monitor follows a sequence of steps comprising a panel undercutting step, a top coal and pillar removal step, and a boiling up step to thereby break and particulate the coal.

* * * * *